US005492317A

United States Patent [19]

Takemoto et al.

[11] Patent Number: 5,492,317

[45] Date of Patent: Feb. 20, 1996

[54] PAPER STRIP TRANSPORTING APPARATUS

[75] Inventors: Takatoshi Takemoto; Koichi Tsubota, both of Tokyo; Hideyuki Kadomatsu, Odawara; Etsurou Sasaki, Kawasaki, all of Japan

[73] Assignee: Kabushiki Kaisha Ace Denken, Japan

[21] Appl. No.: 266,038

[22] Filed: Jun. 27, 1994

[51] Int. Cl.[6] ..... B65H 5/26

[52] U.S. Cl. ..... 271/9.13; 271/272; 271/275; 271/264; 271/121

[58] Field of Search ..... 271/264, 272–274, 271/275, 198, 9, 9.13

[56] References Cited

U.S. PATENT DOCUMENTS

| | | | |
|---|---|---|---|
| 4,373,712 | 2/1983 | Mitzel | 271/275 |
| 5,168,290 | 12/1992 | Tanaka et al. | 271/275 |

FOREIGN PATENT DOCUMENTS

| | | | |
|---|---|---|---|
| 60-106744 | 6/1985 | Japan | 271/272 |
| 1-28146 | 1/1989 | Japan | 271/272 |
| 1-288540 | 11/1989 | Japan | 271/9 |
| 3-83747 | 4/1991 | Japan . | |
| 4-2605490 | 9/1992 | Japan | 271/121 |

OTHER PUBLICATIONS

Anderson et al, Document Feeding (IBM Technical Disclosure Bulletin), Jul. 1977, vol. 20 No. 12 pp. 498–499.

*Primary Examiner*—H. Grant Skaggs

*Attorney, Agent, or Firm*—Andrus, Sceales, Starke & Sawall

[57] ABSTRACT

The paper strip conveying apparatus includes a conveying roller which is provided in such a manner that the outer peripheral plane comes into contact with one surface of a paper strip, a roller drive mechanism which rotates the conveying roller and a paper strip biasing member which is provided in such a manner that the tip portion comes into contact with the other surface of the paper strip. A convex portion is formed circularly along the outer peripheral plane of the conveying roller. The paper strip biasing member has a concave portion into which the convex portion of the conveying roller fits without contact at the tip portion. When the paper strip is sandwiched between the conveying roller and the paper strip biasing member, since the convex portion of the conveying roller fits into the concave portion of the paper strip biasing member, the paper strip is forcedly flexed so as to be urged onto the convex portion of the conveying roller and conveyed by the rotation of the conveying roller. In the other cases, since the conveying roller and the paper strip biasing member do not come into contact with each other, the conveying roller does not receive any external force, which results in reduction of rotation load of the conveying roller.

6 Claims, 11 Drawing Sheets

PAPER STRIP TRANSPORTING APPARATUS

BACKGROUND OF THE INVENTION

There are a plurality of pachinko islands provided in a game parlor. The pachinko island has a plurality of pachinko machines at which players can enjoy playing pachinko games using pachinko balls, a plurality of ball lending machines which accept bank notes so as to dispense a certain number of balls based on the value of the bank notes, a charge storing box for storing the bank notes inserted into the plurality of ball lending machines and a conveying apparatus for conveying the bank notes inserted into the plurality of ball lending machines to the charge storing box. In a pachinko island, a plurality of pachinko machines and a plurality of ball lending machines are provided alternately in a straight line so as to constitute rows of pachinko machines. The bank note conveying machines are provided behind and along the rows of pachinko machines. The bank note conveying machine has, in addition to a main conveying path provided in a line along a row of pachinko machines, an introducing path for introducing the paper strip from the ball lending machine to the main conveying path.

Prior art concerning bank notes in an introducing path is disclosed in, for example, a Japanese Patent Publication No. 3-83747.

The bank note conveying machine has a cylindrical conveying roller provided along the introducing path, a roller drive mechanism for rotating the conveying roller, and a cylindrical biasing roller provided so as to face the conveying roller having the introducing path therebetween. The biasing roller is provided in such a manner that the outer peripheral plane of the biasing roller is in contact with the outer peripheral plane of the conveying roller, enabling rotation at all times in accordance with the rotation of the conveying roller. The bank note is conveyed through the introducing path, being sandwiched between the conveying roller and the biasing roller.

According to the prior art, however, since the biasing roller is always rotated by the rotation of the conveying roller, the rotation load is increased, which results in higher running cost.

DISCLOSURE OF THE INVENTION

The present invention solves the conventional problem as stated above and the object of the present invention is to provide a paper strip conveying apparatus which enables reduction of the running cost in conveying paper strips.

The paper strip conveying apparatus which accomplishes the object comprises:

- a conveying path member in which a conveying path through which a paper strip is conveyed is formed;
- a conveying roller having a rotating shaft which is perpendicular with respect to the conveying direction of said paper strip in said conveying path, at least a part of which is disposed in said conveying path member so that the outer peripheral plane of the conveying roller comes into contact with one of the two surfaces of said paper strip;
- a roller drive mechanism which rotates said conveying roller in the rotation direction of said rotating shaft; and
- a paper strip biasing member which opposes said conveying roller with said conveying path therebetween and a tip portion of which is disposed in said conveying path member so that the tip portion comes into contact with the other face of said paper strip; wherein
- said conveying roller has a convex portion in a ring configuration along said outer peripheral plane of the conveying roller; and
- said paper strip biasing member has a concave portion at the tip portion, into which said convex portion of said conveying roller is disposed without contact.

According to the above-mentioned paper strip conveying apparatus, when the paper strip is positioned between the conveying roller and the paper strip biasing member, since the convex portion of the conveying roller cuts into the concave portion of the paper strip biasing member, the paper strip is forcedly flexed to be urged onto the convex portion of the conveying roller 50. In this way, the paper strip is conveyed by the rotation of the conveying roller. In a case where the paper strip is not positioned between the conveying roller and the paper strip biasing member, since the conveying roller is not in direct contact with the paper strip biasing member, the conveying roller receives no external force and the rotation load of the conveying roller can be reduced.

In addition, the relationship between the convex portion of the conveying roller and the concave portion of the paper strip biasing member is so relative that the concave portion may be formed on the conveying roller and the convex portion may be formed on the paper strip biasing member.

DESCRIPTION OF PREFERRED EMBODIMENT

Figure 2:
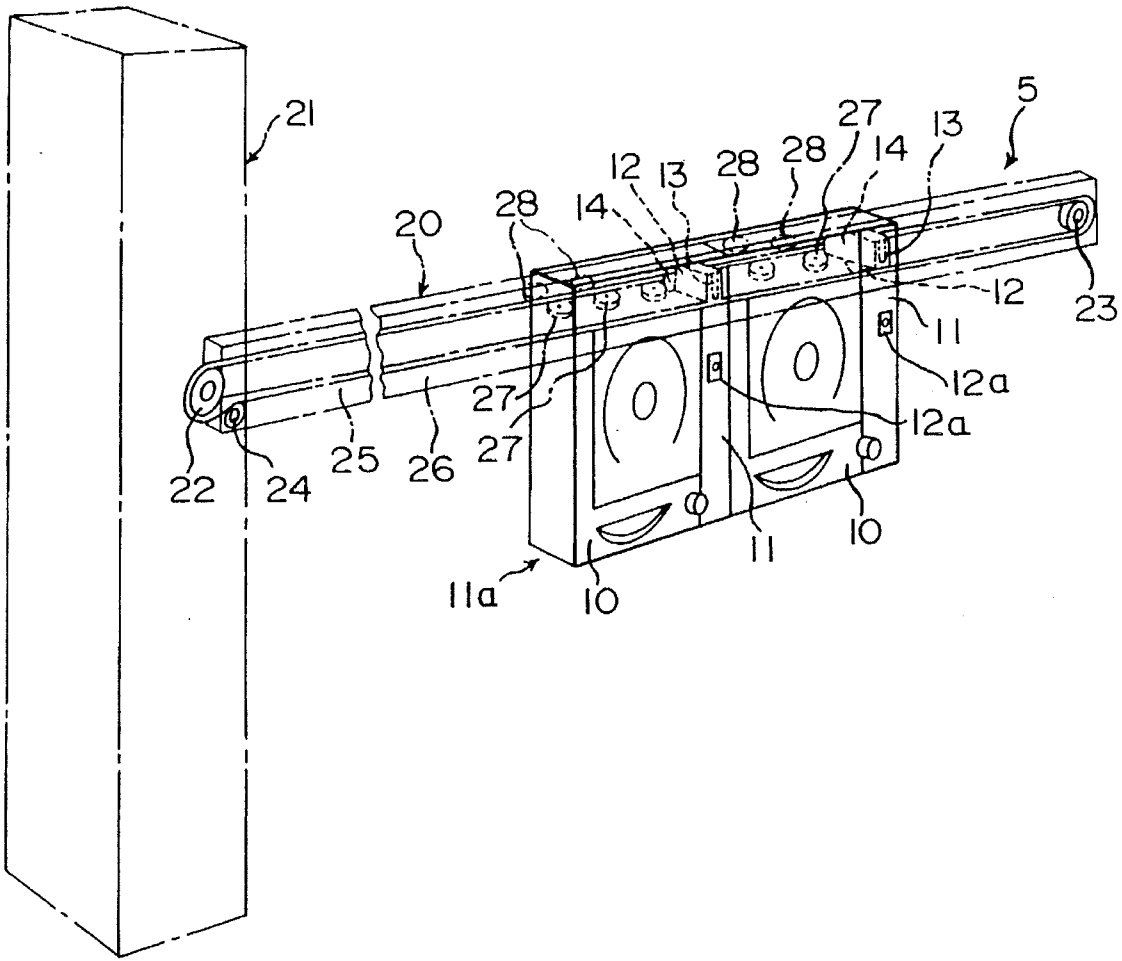
FIG. 2 is a perspective view of the pachinko island provided with the conveying apparatus in the embodiment of the present invention.
Figure 3:
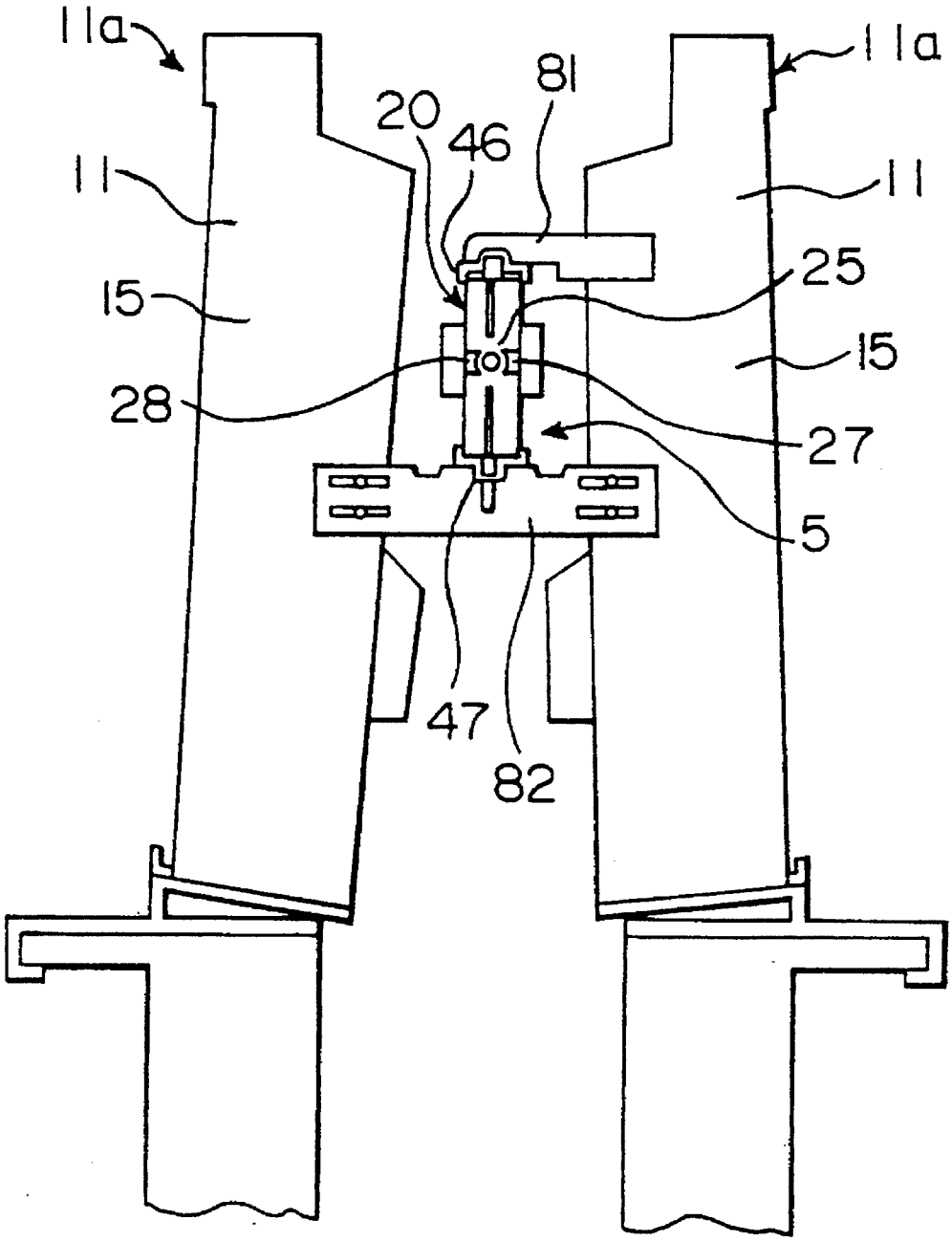
FIG. 3 is a side view of the main portion of the pachinko island provided with the conveying apparatus in the embodiment of the present invention.

As shown in FIG. 2, a pachinko island comprises a plurality of pachinko machines 10, 10, ... at which players enjoy games using pachinko balls, a plurality of ball lending machines 11, 11, . . . which accept a bank note and dispense a certain number of balls based on the value of the accepted bank note, a charge storing box 21 for storing the bank notes inserted into the plurality of ball lending machines 11, 11, . . . and a conveying apparatus 5 for conveying the bank notes inserted into the plurality of ball lending machines 11, 11, . . . to the charge storing box 21. The plurality of pachinko machines 10, 10, . . . and the plurality of ball lending machines 11, 11, . . . , respectively, are arranged alternately in a straight line to form a row of pachinko machines 11*a*. In the pachinko island, as shown in FIG. 3, two rows of pachinko machines 11*a*, 11*a* are arranged back to back with each other in parallel having a certain space therebetween. The conveying machine 5 is provided between the backs of the two rows of pachinko machines 11*a*, 11*a*, along the row of pachinko machines 11*a*. The charge storing box 21 is provided on one end of the two rows of pachinko machines 11*a*, 11*a*.

The ball lending machine 11 has a bank note examining unit 12 for judging whether the bank note is appropriate or not and for determining the value of the bank note, and a ball dispensing unit 12*a* for dispensing a certain number of balls based on the value of the bank note determined by the bank note examining unit 12. In the bank note examining unit 12, a bank note inserting slot 13 is formed at a position corresponding to the front of the ball lending machine 11 and a bank note discharging slot 14 is formed at a position corresponding to the back of the ball lending machine 11.

The conveying apparatus 5 includes a charge collecting line 20 which is formed straightly along the back of the row of pachinko machines 11*a*. At both ends of the charge collecting line 20, a drive pulley 22 and a driven pulley 23 are provided. An endless round belt 25 is tensioned between the drive pulley and the driven pulley. A pair of biasing pulleys 27, 28 which sandwich the round belt 25 from both sides are provided in a section between the drive pulley 22 and the driven pulley 23 where the round belt 25 is tensioned. A tension pulley 24 which adjusts the tensile force of the round belt 25 is provided on one end of the drive pulley 22 side.

Figure 1:
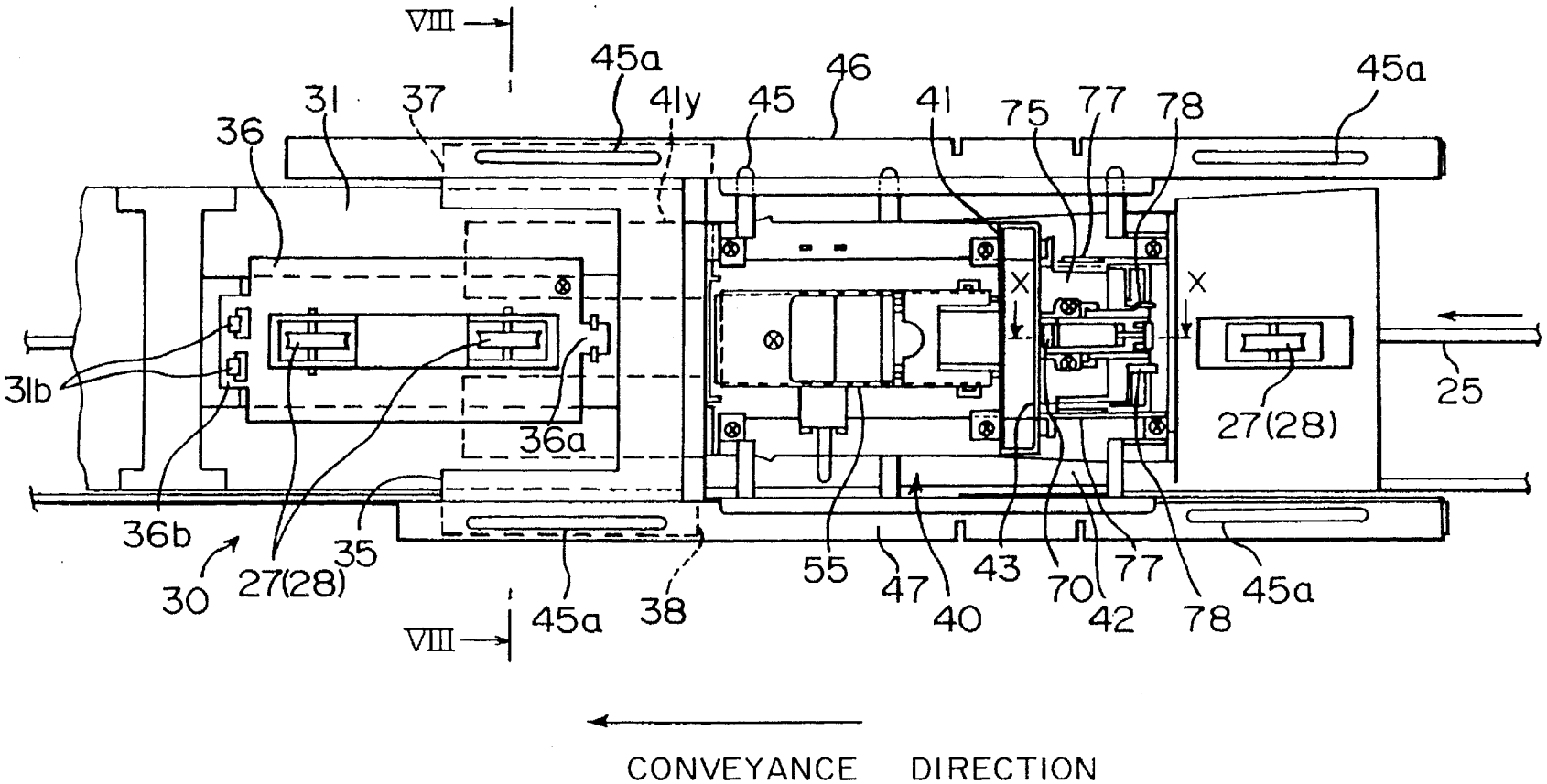
FIG. 1 is a front view of the main portion of the paper strip conveying apparatus in an embodiment of the present invention.

As shown in FIG. 1, a plurality of conveying units 30, 30, . . . which form the charge collecting line 20, and convey the bank notes to the charge storing box 21 and a plurality of introducing units 40, 40, . . . which introduce the bank notes from the ball lending machines 11, 11, . . . are continuously provided so as to form the conveying apparatus 5.

The conveying unit 30 and the introducing unit 40 are, as shown in FIG. 3, supported from the top and the bottom by connecting guide members 46, 47 which form a main body frame.

The connecting guide members 46, 47 on the top and bottom of the conveying apparatus 5 are supported on a side wall board 15 of the ball lending machine 11 via fixing metallic parts 81, 82.

Figure 10:
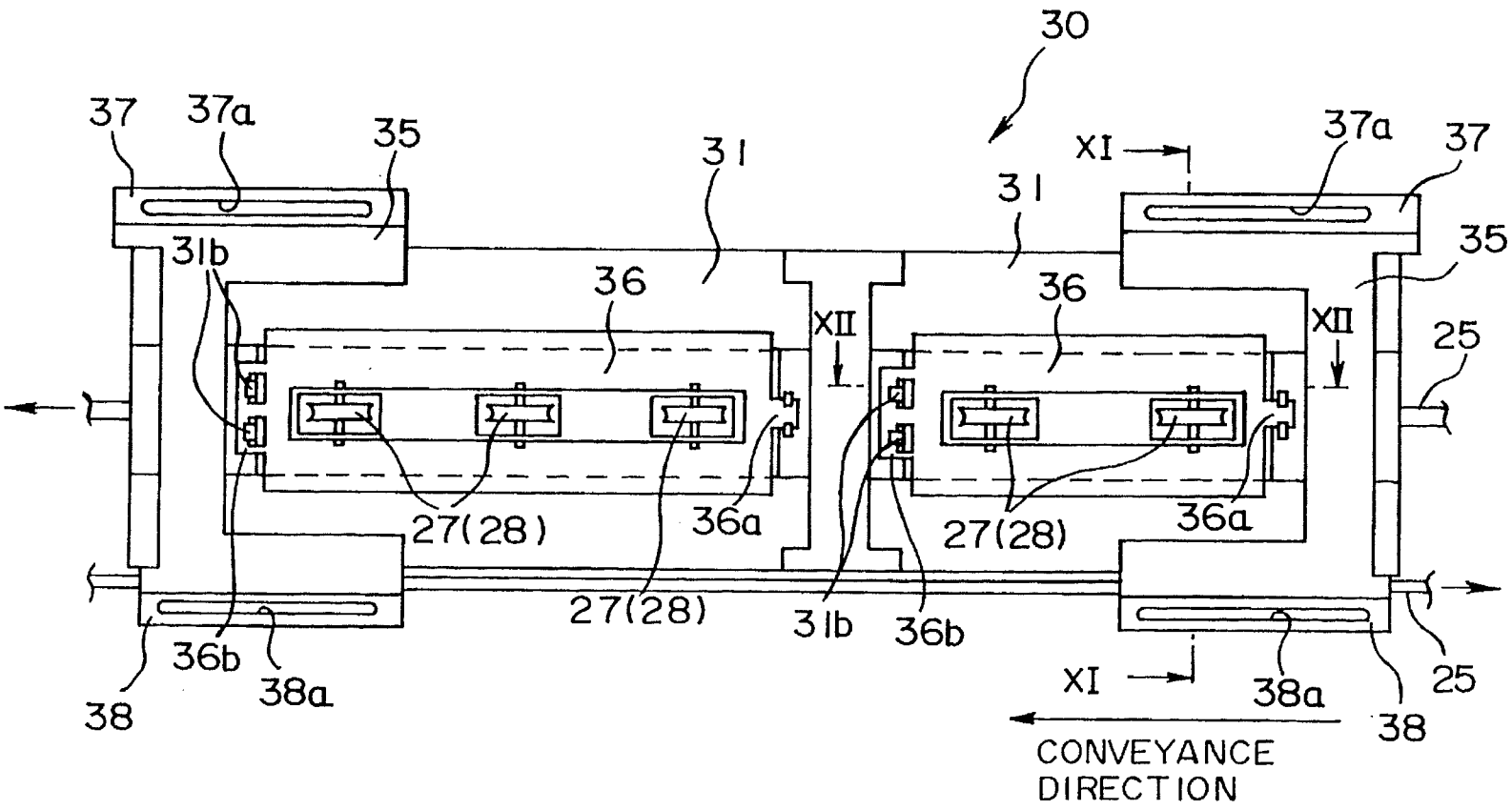
FIG. 10 is a front view of the conveying unit in the embodiment of the present invention.
Figure 11:
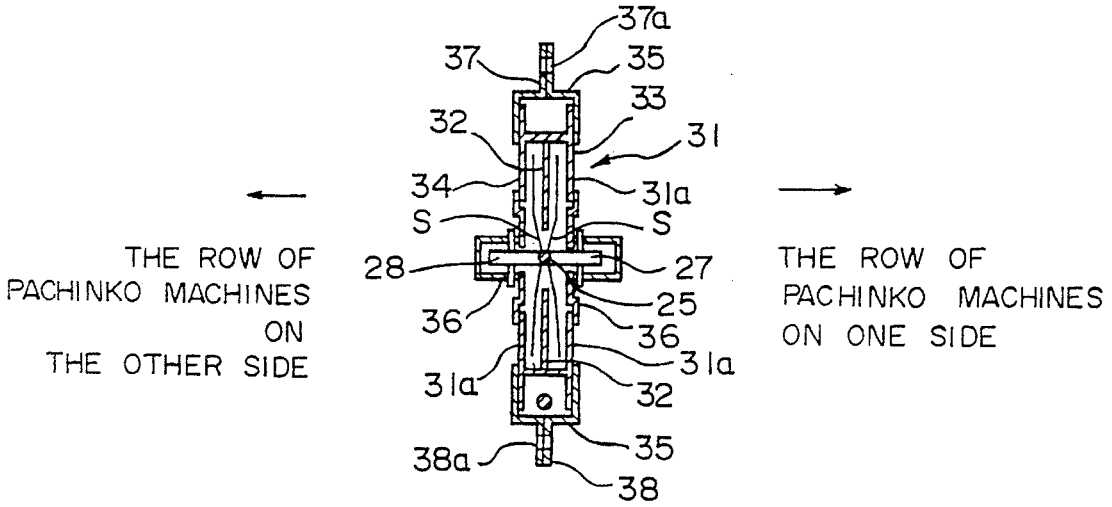
FIG. 11 is a cross sectional view taken along a line XI—XI of FIG. 10.

The conveying unit 30 comprises, as shown in FIGS. 10 and 11, a conveying path member 31 which forms the charge collecting line 21 surrounding the bank note to be conveyed, joint members 35, 35*a* provided on both ends of the conveying path member in the direction of conveyance and the above-described biasing pulleys 27, 28.

Figure 12:
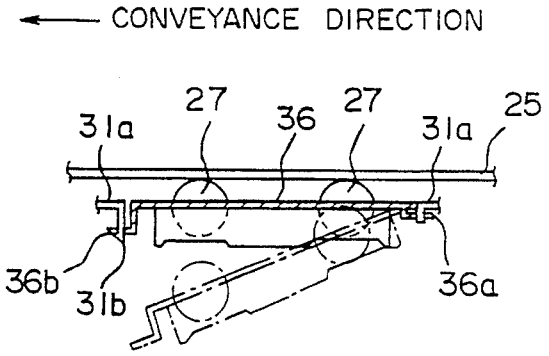
FIG. 12 is a cross sectional view taken along a line XII—XII of FIG. 10.
Figure 14:
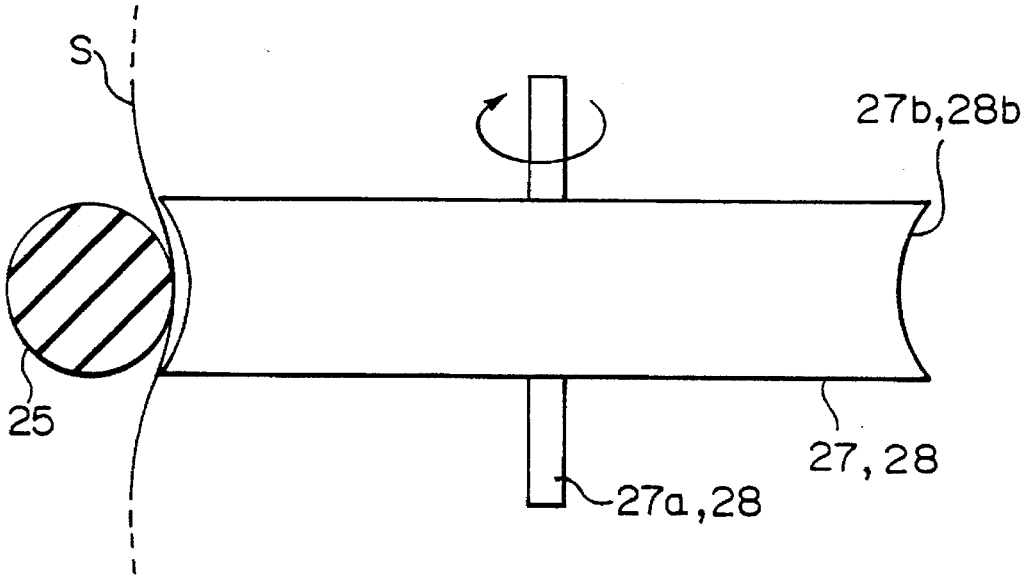
FIG. 14 is a front view of the biasing pulley of the embodiment of the present invention.

The conveying path member 31 includes, as shown in FIG. 11, having the round belt 25 as the center, a first conveying path forming portion 33 which forms a conveying path for the row of pachinko machines on one side, a second conveying path forming portion 34 which forms a conveying path for the row of pachinko machines on the other side, and a partition 32 which partitions the first conveying path forming portion 33 and the second conveying path forming portion 34. The above-described biasing pulleys 27, 28 are respectively provided on the row of pachinko machines on one side and the row of pachinko machines on the other side, having the round belt 25 therebetween. As shown in FIG. 14, the biasing pulleys 27, 28 have rotating shafts 27*a*, 28*a* which are vertical to the direction where the charge collecting line 21 extends and substantially parallel to the bank note to be conveyed. Concave portions 27*b*, 28*b* are formed on the outer peripheral plane of the biasing pulleys 27, 28. The concave portions 27*b*, 28*b* are formed in such a manner that the middle portion of the outer peripheral plan in a direction which is parallel to the rotating shafts 27*a*, 28*a* caves into a direction of the rotating shaft. The biasing pulleys 27, 28 are covered with pulley fixing boards 36, 36 and the rotating shafts of the biasing pulleys are fixed on the pulley fixing boards 36, 36. As shown in FIG. 14, the biasing pulleys 27, 28 are provided at a position where a part of the round belt 25 comes into the concave portions 27*b*, 28*b* of the biasing pulleys but does not come into direct contact with the concave portions. Each of the conveying path forming portions 33, 34 of the conveying path member 31 has side walls 31*a*, 31*a* having an opening formed thereon. The pulley fixing board 36 is fixed on the side wall 31*a* so as to block the opening of the side wall 31*a*. As shown in FIG. 12, one end 36*a* of the pulley fixing board 36, in a direction of conveyance of bank notes, is attached to a board fixing portion formed on one side of an edge of the opening of the side wall 31*a* so as to be able to swing. On the other end of the pulley fixing board 36 in a direction of conveyance of bank notes, an engaging portion 36*b* which is detachable from a hook 31*b* formed on the other side of the edge of the opening of the side wall 31*a* is formed.

The joint member 35 has connecting rails 37, 38 extending toward the conveyance direction of bank notes on upper and lower parts of both ends of the conveying path member 31 in the conveyance direction. Elongated holes 37*a*, 38*a* elongated in the conveyance direction of bank notes, which pass through from the row of pachinko machines on one side to the row of pachinko machines on the other side, are formed on the connecting rails 37, 38.

Figure 4:
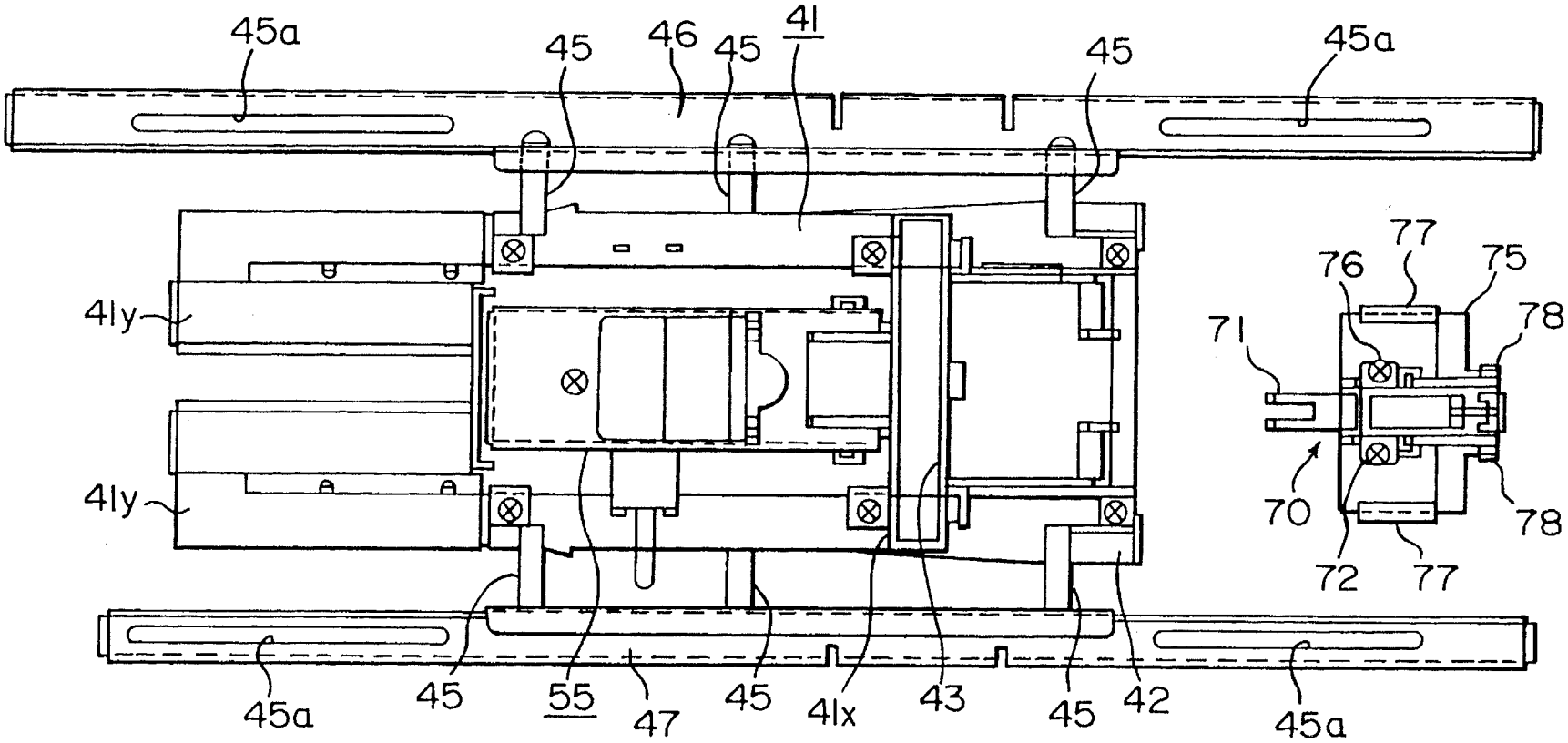
FIG. 4 is a front view of the introducing unit in the embodiment of the present invention.
Figure 8:
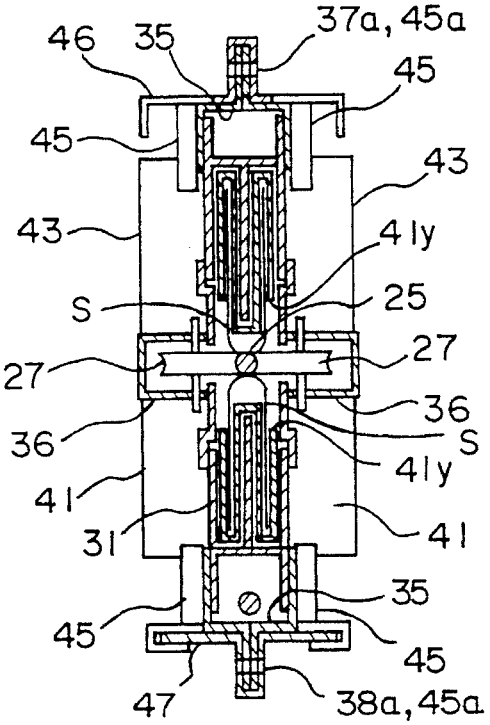
FIG. 8 is a cross sectional view taken along a line VIII—VIII of FIG. 1.
Figure 9:
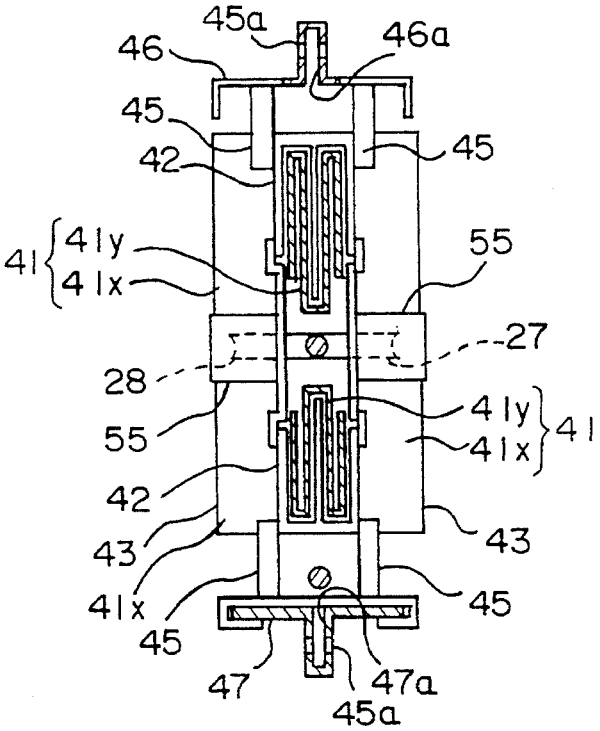
FIG. 9 is a cross sectional view taken along a line IX—IX of FIG. 13.
Figure 13:
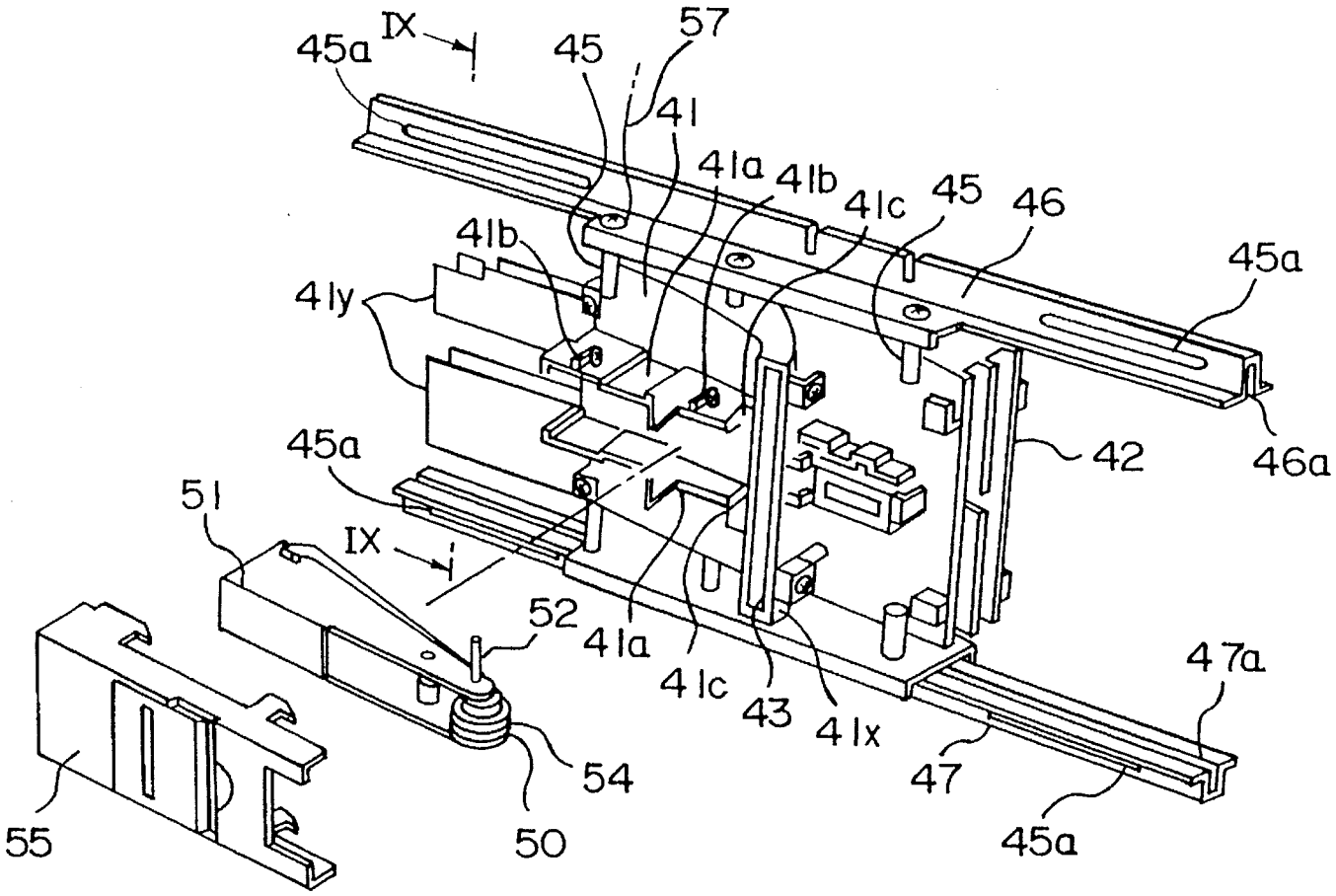
FIG. 13 is a perspective view of the introducing unit of the present invention.

As shown in FIGS. 4 and 13, the introducing unit 40 has a conveying path member 42 which forms a part of the charge collecting line 20 and an introducing path member 41 which introduces the bank note from the bank note discharging slot 14 of the ball lending machine 11 to the charge collecting line 20 formed by the conveying path member 42. The sectional shape of the conveying path member 42 is, as shown in FIGS. 9 and 13, substantially the same as the conveying path member 31 of the conveying unit 30. Thus, when connecting the introducing unit 40 and the conveying unit 30, the conveying path members 42, 31 of each of the units confront each other. The conveying path member 42 is not shown in section in FIG. 9. The introducing path member 41, provided with a bank note receiving slot connected to the bank note discharging slot 14 of the ball lending machine 11, comprises a guide portion 41*x* which curves gradually, as it gets nearer to the charge collecting line, towards where the charge collecting line 20 extends, and a confluence portion 41*y* connected to the guide portion 41*x* and provided within the conveying path member 42 comprising the charge collecting line 20. As shown in FIGS. 4 and 13, a part of the confluence portion 41*y* projects from the conveying path member 42 in the direction of conveyance. The projection of the confluence portion 41*y* fits in the conveying path member 31 of the conveying unit 30 when connecting the introducing unit 40 with the conveying unit 30, as shown in FIGS. 1 and 8.

Both of the conveying path member 42 and the introducing path member 41 of the introducing unit 40 are, as shown in FIG. 13, connected to the above-mentioned upper connecting guide member 46 and lower connecting guide member 47 by screws 45, 45, . . . . The connecting guide members 46, 47 are extended in the conveyance direction of bank notes, and grooves 46*a*, 47*a*, into which the connecting rails 37, 38 of the conveying unit 30 can fit, are formed thereon. Similar to the connecting rails 37, 38 of the conveying unit 30, elongated holes 45*a*, 45*a* elongated in the conveyance direction of bank notes, which pass through from the row of pachinko machines on one side to the row of pachinko machines on the other side, are formed on the connecting guide members 46, 47.

The introducing unit 40 is connected to the conveying unit 30 in such a manner that the confluence portion 41*y* of the introducing path member 41 fits in the conveying path member 31 of the conveying unit 30, and that the conveying path member 42 and the conveying path member 31 of the conveying unit 30 confront with each other. The connecting rails 37, 38 of the conveying unit 30 fit in the grooves 46*a*, 47*a* of the connecting guide members 46, 47 and are connected to the introducing unit 40 by the screws 45. The screws are inserted into the elongated holes 45*a*, 45*a* of the connecting guide members 46, 47 and into the elongated holes 37*a*, 38 *a* of the connecting rails 37, 38 of the conveying unit 30, so that the connecting guide members 46, 47 and the conveying unit 30 are connected by the screws. Since the elongated holes 45*a*, 37*a* . . . , into which the screws are inserted, are elongated toward the conveying direction of the paper strip, the relative position between the conveying unit 30 and the connecting guide members 46, 47 in the conveying direction of the paper strip can be adjusted. Accordingly, the relative position between the introducing unit 40 which is fixed to the connecting guides 46, 47 with the screws 45 and the conveying unit 30 in the conveying direction of the paper strip can be also adjusted.

The introducing unit 40 further includes biasing pulleys 27*x*, 28*x* provided on both sides of the round belt 25, a conveying roller 50 provided on one side of the introducing path formed with the introducing path member 41, a leaf spring 70 provided on the other side of the introducing path, a roller case 51 which covers the biasing pulley 27*x* and the conveying roller 50 and a cover 55 which externally covers the roller case 51.

Figure 5:
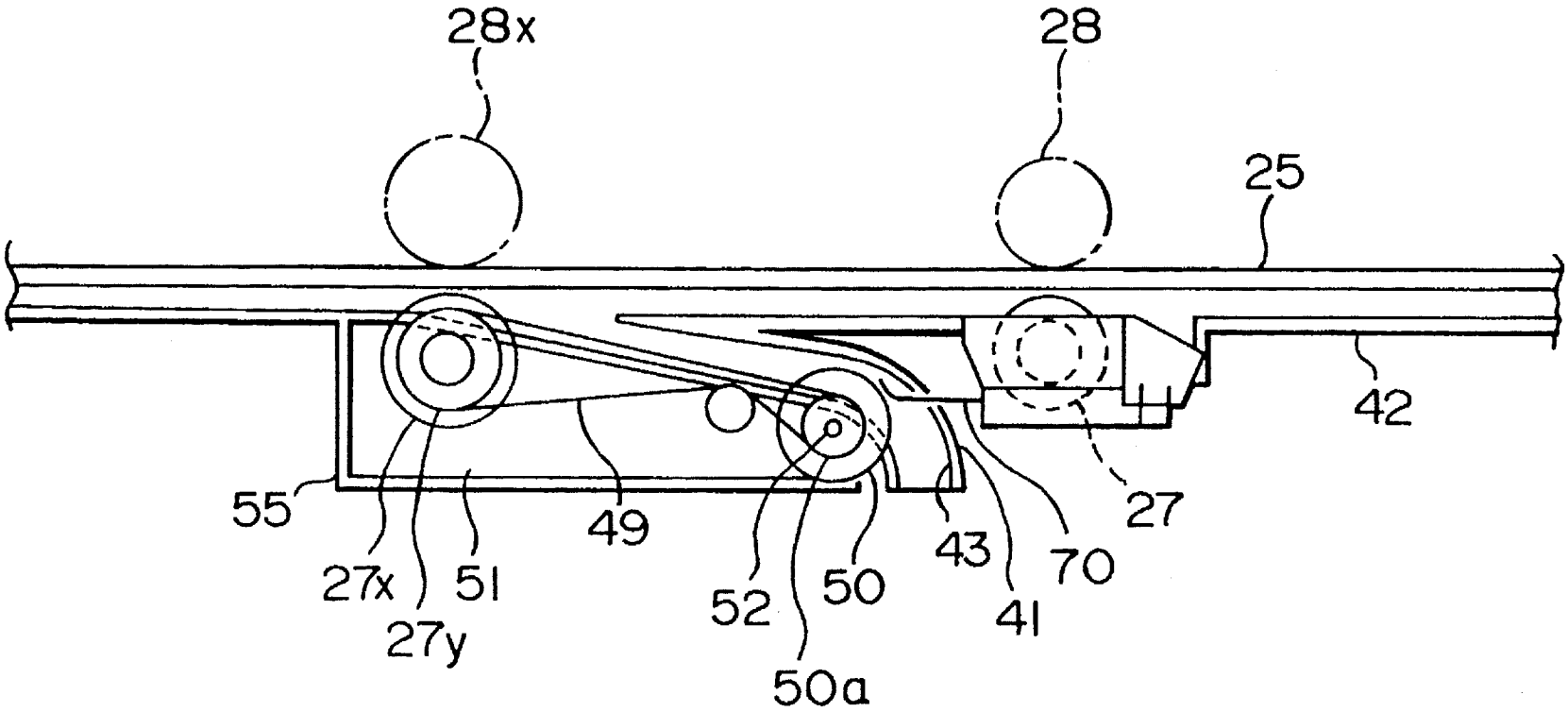
FIG. 5 is a plan figure of the main portion of the introducing unit in the embodiment of the present invention.
Figure 7:
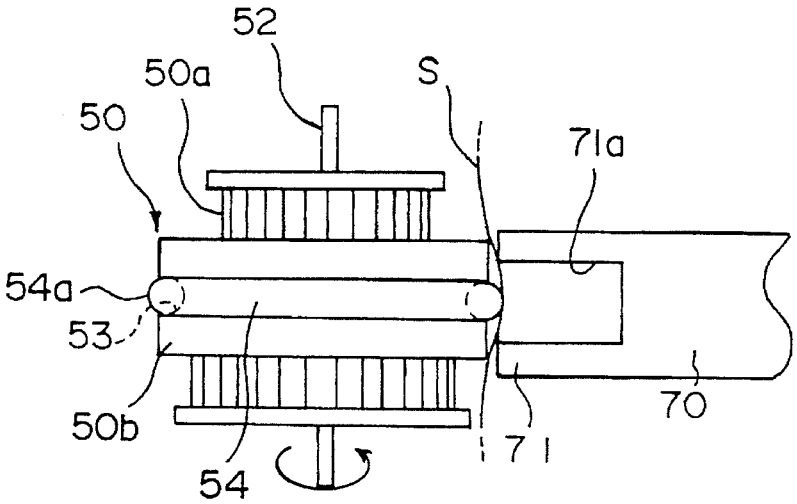
FIG. 7 is a front view of the conveying roller in the embodiment of the present invention.

As shown in FIGS. 5 and 14, the biasing pulley 27*x* is supported on a part of the roller case 51 via the rotation shaft. The conveying roller 50 is supported rotatably on the other part of the roller case 51 via the roller shaft 52. Belt pulleys 27*y*, 50*a* are provided on the biasing pulley 27*x* and the conveying roller 50, respectively, in one body. A timing belt 49 is tensioned between the belt pulley 27*y* of the biasing pulley 27*x* and the belt pulley 50*a* of the conveying roller 50. As shown in FIG. 7, an outer peripheral groove 53 is formed at the outer periphery of the conveying roller main body 50*b*, and an O-ring 54 is disposed therein. Thus, the conveying roller 50 has a convex portion 54*a* by having the O-ring 54 on its outer peripheral plan. In the introducing path member 41, a frame 41*a* for inserting the roller case 51 is formed. On both side walls of the frame 41*a*, projections 41*b* for fixing the cover which covers the roller case 51 are formed, and a fitting groove 41*c* is formed, into which the introducing roller shaft 52 fits, for limiting the advance of the introducing roller shaft 52 into the introducing path.

Figure 6:
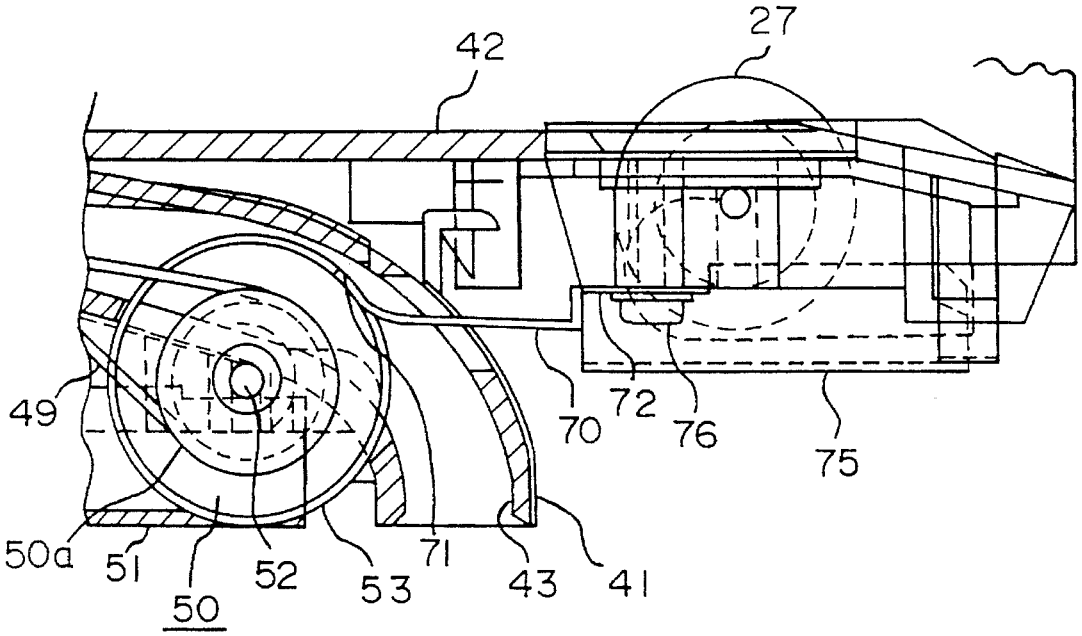
FIG. 6 is a plan figure of the main portion of the introducing unit in the embodiment of the present invention.

On the conveying path member 42 facing the conveying roller 50, having the introducing path of the introducing unit 40 therebetween, as shown in FIG. 6, the leaf spring 70 which sandwiches paper strips or the like with the conveying roller 50 is provided via a holder member 75. On a tip portion 71 of the leaf spring, as shown in FIG. 7, a concave portion 71*a* is formed so as to keep out of a convex portion 54*a* of the conveying roller 50. A base portion 72 of the leaf spring 70 is fixed to a holder member 75 with a screw member 76 so that the gap between the tip portion 71 of the leaf spring 70 and the outer peripheral surface of the introducing roller 50 is kept so as to be as wide as the thickness of the bank note.

As shown in FIGS. 1 and 4, the guided flange 77 of the guide portion formed on the conveying path member 42 is formed on the upper and lower edge portions of the holder member 75, respectively. Furthermore, a stopper flange 78 for preventing the holder member 75 from dropping off, which fits in the groove formed on the conveying path member 42, is formed at the rear end portion of the holder member 75.

In addition, the biasing pulley 27*x* of the introducing unit 40, being different from the biasing pulley 27 of the conveying unit 30, is provided to be in contact with the round belt so as to rotate all the time according to the movement of the round belt 25.

Next, the operation of the conveying apparatus 5 of the present embodiment will be described.

The biasing pulley 27*x* of the introducing unit 40 is different from the biasing pulley 27 of the conveying unit 30 in that the biasing pulley 27*x* always rotates according to the movement of the round belt 25. The belt pulley (drive pulley) 27*y* which is provided integrally to the biasing pulley 27*x* and the belt pulley (driven pulley) 50*a* of the conveying roller 50 are connected by the timing belt 49. Accordingly, the conveying roller 50 always rotates according to how far the round belt 25 moves.

When a bank note S is inserted into the introducing path of the introducing unit 40 from the discharging slot 14 of the ball lending machine 11, the bank note S is sandwiched between the conveying roller 50 and the leaf spring 70. Although the conveying roller 50 and the leaf spring 70 do not come into contact with each other, the bank note S is forcedly flexed to be urged onto the convex portion 54*a* of the conveying roller 50, because the convex portion 54*a* of the conveying roller 50 comes into the concave portion 71*a* of the leaf spring 70, as shown in FIG. 7. As a result, the bank note S is conveyed to the charge collecting line 20 by the rotating conveying roller 50.

When the bank note S reaches the charge collecting line 20, the bank note S is sandwiched between the round belt 25 and the biasing pulley 27 so as to be conveyed through the charge collecting line 20 to the charge storing box 21. The relationship between the biasing pulley 27 and the round belt 25 in the conveying unit 30 is similar to the relationship between the conveying roller 50 and the leaf spring 70 in the introducing unit 40. That is, although the biasing pulley 27 and the round belt 25 do not come in contact with each other, as shown in FIG. 14, a part of the round belt 25 comes into the concave portion 27*b* of the biasing pulley 27 so that the bank note S is forcedly flexed to be urged onto the round belt 25. As a result of this, the bank note S is conveyed to the charge storing box 21 by the round belt 25.

Since the conveying roller 50 and the leaf spring 70 do not come in contact with each other in the introducing unit 40, the conveying roller 50 does not receive external force except when the conveying roller 50 comes in contact with the bank note. This enables the reduction of the load for rotating the conveying roller 50. Furthermore, since the round belt 25 and the biasing pulley 27 do not come in contact with each other in the conveying unit 30, the load for operating the round belt 25 can be reduced for the reason described above. Therefore, according to the present embodiment, the running cost can be lowered by the reduction of the load of the conveying apparatus.

In addition, in these embodiments, although the concave portion 71*a* is formed on the leaf spring 70 and the convex portion 54*a* is formed on the conveying roller 50, the relation between the convex and concave portions is so relative that the convex portion may be formed on the leaf spring 70 and the concave portion may be formed on the conveying roller 50 as a matter of course. Similarly, the convex and concave portions on the round belt 25 and the biasing pulley 27 may be formed reversely.

If any difficulty in conveyance should occur in the conveying path, the holder member 75, the cover 55 and the roller case 51 are disengaged so as to enable the inside of the introducing unit 40 to be inspected.

In the charge collecting line 20, paper strips and the like are sandwiched between the biasing pulleys 27, 28 and the round belt 25, and are then conveyed in order.

If any difficulty in conveyance should occur in the charge collecting line 20, as shown in FIG. 12, the pulley fixing board 36 is opened.

One of the pair of biasing pulleys 27, 28 moves away from the round belt 25 when the pulley fixing board 36 is opened. This enables inspection of the inside of the conveying unit 30.

We claim:

1. A paper strip conveying apparatus which conveys a paper strip along an object conveying path comprises:

a conveying path member in which said object conveying path along which said paper strip is conveyed is formed;

a conveying roller having a rotating shaft which is perpendicular with respect to the conveying direction of said paper strip in said object conveying path, at least a part of which is disposed in said conveying path member so that the outer peripheral surface of the conveying roller comes into contact with one of the two surfaces of said paper strip;

a roller drive mechanism which rotates said conveying roller and said rotating shaft; and a paper strip biasing member which opposes said conveying roller with said conveying path therebetween and having a tip portion of which is disposed in said conveying path member so that the tip portion comes into contact with the other face of said paper strip; wherein said conveying roller has a convex portion in a ring configuration along said outer peripheral surface of the conveying roller; and said paper strip biasing member has a concave portion at the tip portion, into which said convex portion of said conveying roller is disposed without contact, said paper strip biasing member comprising a leaf spring formed of a thin metal sheet.

2. A paper strip conveying apparatus as defined in claim 1, wherein:

said conveying roller includes a roller main body which is formed as a cylinder having said rotating shaft as a center shaft and which has a ring shaped groove on the outer peripheral surface of the cylinder; and a circular elastic member, a part of which comes into the ring shaped groove of said roller main body so as to form said convex portion.

3. A paper strip conveying apparatus which introduces a paper strip from a paper strip discharging machine which is positioned along an object conveying path and conveys the paper strip along the conveying path comprising:

a conveying path member which forms said object conveying path along which said paper strip is conveyed;

an endless belt, an extended part of which is provided along said object conveying path and the outer peripheral surface of which comes into contact with one of the two surfaces of said paper strip conveyed along the conveying path;

a belt drive mechanism which rotates said endless belt;

a plurality of pulleys provided along said object conveying path having rotating shafts which are perpendicular with respect to the conveying direction of said paper strip in said object conveying path, the outer peripheral surfaces of said pulleys coming into contact with the other surface of the paper strip;

an introducing path member in which an introducing path for introducing the paper strip from said paper strip discharging machine to said object conveying path is formed;

a conveying roller having a rotating shaft which is vertical with respect to the conveying direction of said paper strip in said introducing path, at least a part of which is disposed in said introducing path member so that the outer peripheral surface of the conveying roller comes into contact with one of the two surfaces of said paper strip which has reached the introducing path from said paper strip discharging machine;

a roller drive mechanism which rotates said conveying roller and said rotating shaft of said conveying roller; and a paper strip biasing member which opposes said conveying roller with said introducing path therebetween and a tip portion of which is disposed in said introducing path member so that the tip portion comes into contact with the other surface of said paper strip; wherein said conveying roller has a convex portion in a ring configuration along said outer peripheral surface of the conveying roller; and said paper strip biasing member has a concave portion at the tip portion, into which said convex portion of said conveying roller is disposed without contact.

4. A paper strip conveying apparatus as defined in claim 3, wherein:

said endless belt has a circular sectional shape;

a plurality of said pulleys each have a concave portion extending inwardly toward said rotating shaft of said pulley on said outer peripheral surface of said pulley;

one pulley of plurality of said pulleys is disposed in a position in which, except when said paper strip is sandwiched between said one pulley and said endless belt, the outer peripheries of said one pulley and said endless belt come into contact with each other so that said one pulley rotates at all times when said endless belt moves;

another pulley of a plurality of said pulleys is disposed in a position in which, when said paper strip is sandwiched between said another pulley and said endless belt, one surface of the paper strip comes into contact with the outer peripheral surface of the endless belt and the other surface of the paper strip comes into contact with the outer peripheral surface of said another pulley, but, when said paper strip is not positioned between said another pulley and said endless belt, the outer peripheral surfaces of said another pulley and the endless belt do not come into contact with each other; and said roller drive mechanism includes a drive pulley which is provided integrally to said one pulley so as to rotate with the rotation of said one pulley; a driven pulley which is provided integrally to said conveying roller so as to rotate the conveying roller with its rotation; and a roller drive belt which is tensioned between said drive pulley and said driven pulley.

5. A paper strip conveying apparatus as defined in claim 3, wherein said paper strip biasing member is a leaf spring formed with a thin metal sheet.

6. A paper strip conveying apparatus as defined in claim 3, wherein:

said conveying roller includes a roller main body which is formed as a cylinder having said rotating shaft as a center shaft and which has a ring shaped groove on the outer peripheral surface of the cylinder; and a circular elastic member, a part of which comes into the ring shaped groove of said roller main body so as to form said convex portion.

* * * * *